US009850915B2

(12) United States Patent
Takano

(10) Patent No.: US 9,850,915 B2
(45) Date of Patent: Dec. 26, 2017

(54) POWER TOOL

(75) Inventor: Hideaki Takano, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 654 days.

(21) Appl. No.: 14/131,276

(22) PCT Filed: Jun. 19, 2012

(86) PCT No.: PCT/JP2012/065591
§ 371 (c)(1),
(2), (4) Date: Jan. 7, 2014

(87) PCT Pub. No.: WO2013/005566
PCT Pub. Date: Jan. 10, 2013

(65) Prior Publication Data

US 2014/0147252 A1 May 29, 2014

(30) Foreign Application Priority Data

Jul. 7, 2011 (JP) ..... 2011-150961
Jul. 7, 2011 (JP) ..... 2011-150968

(51) Int. Cl.
*F04D 29/28* (2006.01)
*F04D 29/66* (2006.01)
(Continued)

(52) U.S. Cl.
CPC ..... *F04D 29/668* (2013.01); *B25F 5/008* (2013.01); *F04D 17/165* (2013.01);
(Continued)

(58) Field of Classification Search
CPC ..... F04D 25/0673; F04D 29/2216; F04D 29/2255; F04D 29/281; F04D 29/30;
(Continued)

(56) References Cited

U.S. PATENT DOCUMENTS 4,521,154 A * 6/1985 Corbett ..... F04D 29/30 416/175
6,514,036 B2 * 2/2003 Marshall ..... E01H 1/0809 415/102
(Continued)

FOREIGN PATENT DOCUMENTS

DE 10200951 A1 * 8/2003 ..... A47L 5/22
GB 1293553 A * 10/1972 ..... F04D 29/281
(Continued)

OTHER PUBLICATIONS

Foreign translation of JP60-113097, Japan Platform for Patent Information.*
(Continued)

*Primary Examiner* — Woody Lee, Jr.
*Assistant Examiner* — Jesse Prager
(74) *Attorney, Agent, or Firm* — Oliff PLC

(57) ABSTRACT

A power tool having a built-in fan, the fan including a plurality of blades at uneven pitches. The fan includes a centrifugal fan which blows out air in all radial directions. The fan is provided with means for correcting unstable outflow which may be caused by the uneven pitches between the blades. The blades have unevenly configured inducers for correcting unstable outflow.

9 Claims, 4 Drawing Sheets

(51) Int. Cl.

| | |
|---|---|
| ***F04D 29/22*** | (2006.01) |
| ***F04D 29/30*** | (2006.01) |
| ***F04D 17/16*** | (2006.01) |
| ***F04D 29/42*** | (2006.01) |
| ***F04D 25/06*** | (2006.01) |
| ***B25F 5/00*** | (2006.01) |
| ***F04D 29/44*** | (2006.01) |

(52) U.S. Cl.
CPC ..... *F04D 25/0673* (2013.01); *F04D 29/2216* (2013.01); *F04D 29/281* (2013.01); *F04D 29/30* (2013.01); *F04D 29/4253* (2013.01); *F04D 29/444* (2013.01); *F04D 29/666* (2013.01)

(58) Field of Classification Search
CPC .. F04D 29/4253; F04D 29/444; F04D 29/666; F04D 29/668; F04D 17/16; F04D 17/165; F04D 17/168
See application file for complete search history.

(56) References Cited

U.S. PATENT DOCUMENTS

| | | | | |
|---|---|---|---|---|
| 2007/0122277 | A1* | 5/2007 | Oh | A47L 5/22 415/211.2 |
| 2010/0192314 | A1* | 8/2010 | Otsuka | A47L 9/2884 15/3 |
| 2012/0045338 | A1 | 2/2012 | Tadokoro et al. | |

FOREIGN PATENT DOCUMENTS

| | | | | |
|---|---|---|---|---|
| GB | 2046360 A | * | 11/1980 | A47L 5/22 |
| JP | A-60-113097 | | 6/1985 | |
| JP | S63-54140 A | | 3/1988 | |
| JP | B2-3071977 | | 7/2000 | |
| JP | A-2000-310197 | | 11/2000 | |
| JP | A-2001-170877 | | 6/2001 | |
| JP | A-2002-70793 | | 3/2002 | |
| JP | A-2003-111698 | | 4/2003 | |
| JP | A-2003-139094 | | 5/2003 | |
| JP | B2-3460350 | | 10/2003 | |
| JP | A-2004-249386 | | 9/2004 | |
| JP | A-2006-2691 | | 1/2006 | |
| JP | U-3148914 | | 3/2009 | |
| JP | A-2010-144530 | | 7/2010 | |
| JP | A-2010-261371 | | 11/2010 | |

OTHER PUBLICATIONS

Foreign translation of JPH0731564, Espacenet.*
Sep. 11, 2012 International Search Report issued in International Application No. PCT/JP2012/065591 (with translation).
Mar. 31, 2015 Office Action issued in Japanese Application No. 2011-150961.

* cited by examiner

POWER TOOL

BACKGROUND OF THE INVENTION

Field of the Invention

The present invention relates to a power tool with a built-in fan.

Description of the Related Art

Power tools such as a screw fastening tool or a drilling tool have a built-in fan largely for cooling the electric motor which serves as the power source of the tool, and which is rotated by the same motor. In another aspect, electric tools such as a compact hand vacuum cleaner (known as a handy cleaner; see Japanese Laid-open Patent Application Publication No. 2003-111698) or a dust collector have a built-in fan for generating suction, which is rotated by an electric motor. As such, because a fan installed in a power tool causes vibration and noise as it rotates, some ideas have been proposed for reducing the vibration and noise. For example, Japanese Laid-open Patent Application Publication No. 2010-144530, Japanese Registered Utility Model No. 3148914, Japanese Patent No. 3071977 and Japanese Patent No. 3460350 disclose means for reducing noise and vibration caused by such fans.

Among the above documents, Publication No. 2010-144530 and Registered Utility Model No. 3148914 particularly disclose techniques that use what is known as uneven pitch fan to reduce wind noise or other undesired noise. The uneven pitch fan has angles between blades (i.e. circumferential positions or intervals about the rotation shaft) that are made uneven (i.e. uneven pitches) on a certain basis. For example, some angle may be the golden angle. With an uneven pitch fan, it is possible to reduce uncomfortable narrowband noise around the frequency of NZ/60 Hz (known as NZ noise), where N is the rotation frequency of the fan in 1/min, and Z is the number of blades.

SUMMARY OF INVENTION

In a power tool with a conventional uneven pitch fan installed, unstable outflow is caused because blades in the fan are arranged at uneven pitches. This unstable outflow is likely to cause vibration in the power tool. Thus, it is desired to reduce the vibration generated in the power tool.

In an aspect of the present invention, there is provided a power tool having a built-in dust suction fan, the dust suction fan having a plurality of blades at uneven pitches. The power tool, which may be a handy cleaner or a dust collector, has a built-in uneven pitch fan, which is effective for reducing uncomfortable NZ noise as described above. Thus, it is possible to achieve noise reduction in the power tool.

DETAILED DESCRIPTION OF THE INVENTION

Figure 1:
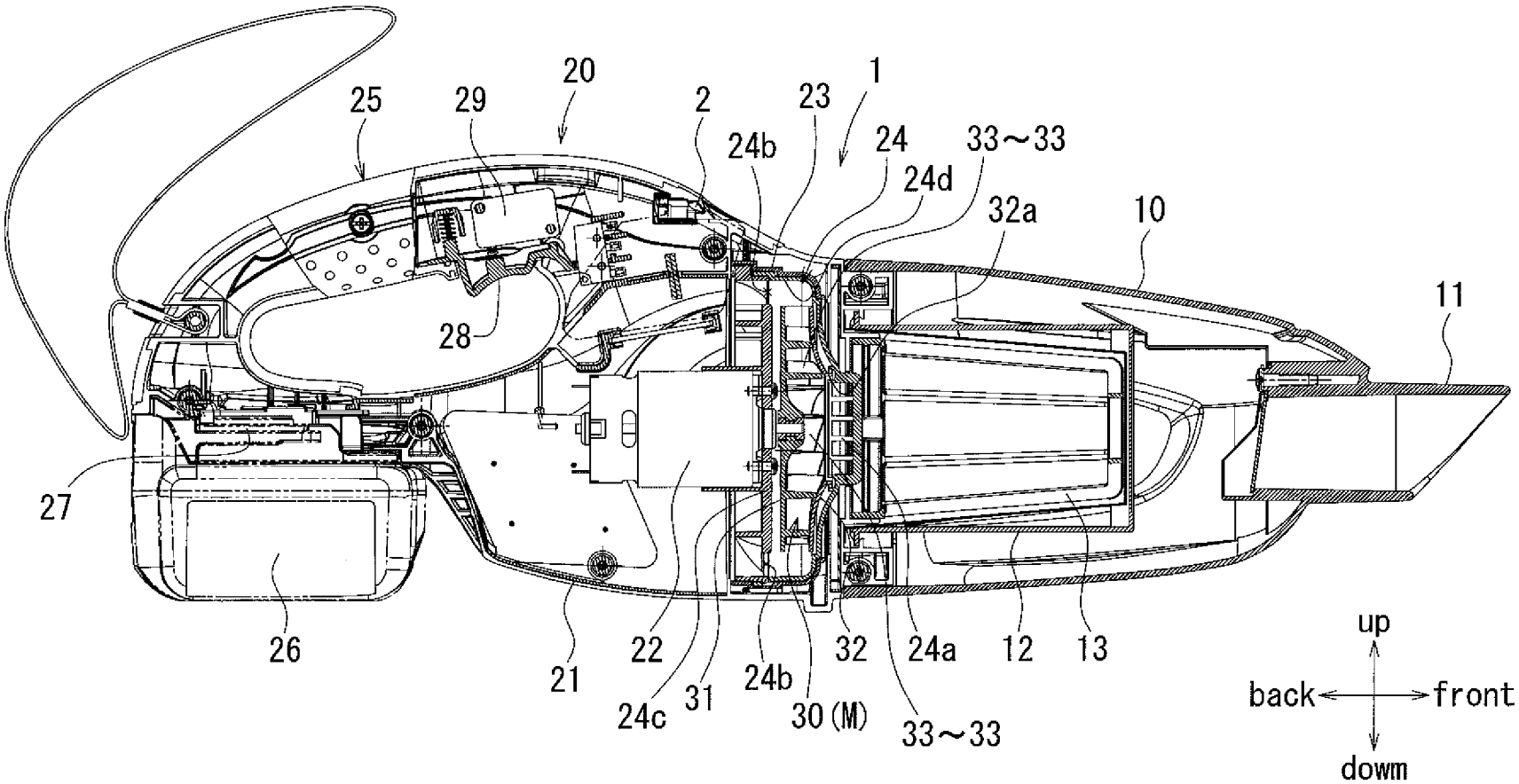
FIG. 1 is a side view of the inside of a handy cleaner with a built-in fan, according to a first embodiment.

Embodiments of the invention will now be described with reference to FIGS. 1 to 6. In the following embodiments, a handy cleaner 1 is taken as an example of a power tool. The present embodiments are characterized largely by a dust suction fan 30 installed in the handy cleaner 1. Since the basic structure of the handy cleaner 1 does not need to be changed in particular, its description will be briefly given.

The handy cleaner 1 comprises a front dust collecting case 10 and a back main body 20. A dust suction nozzle 11 is provided on the front end of the dust collecting case 10. Dust and dirt are sucked through the dust suction nozzle 11 into the dust collecting case 10. A dust filter 12 is disposed behind the dust suction nozzle 11. A filter frame 13 is installed in the front of the main body 20, and the dust filter 12 is mounted on the filter frame 13 in a covering manner. The dust filter 12 is provided so as to protrude from the front of the main body 20 to the inside of the dust collecting case 10. The dust filter 12 prevents dust collected in the case 10 from entering the main body 20. The dust collecting case 10 can be removed from the main body 20 for discarding the dust collected in the case 10.

The main body 20 is the functional part for generating the suction of dust into the dust collecting case 10. The main body 20 includes an electric motor 22 as the power source, and a dust suction fan 30 rotated by the electric motor 22, both of which are installed in a main body housing 21. The dust suction fan 30 is disposed in the front of the main body 20 via a cylindrical fan case 24. An elastic cover 23 for absorbing vibration covers the fan case 24, particularly, its peripheral wall 24*d*. The fan case 24 is supported in the main body housing 21 in the main body 20 via the elastic cover 23. In an embodiment, a rubber cover may be used as the elastic cover 23 so as to function as a vibration absorber. The electric motor 22 is installed in a back base plate 24*c* of the fan case 24.

The dust suction fan 30 used may comprise a centrifugal fan that blows out air in all radial directions. A front side of the fan case 24 is in communication with the inside of the dust filter 12 via an inlet port 24*a* which is provided in the center of the fan case 24. Rotation of the suction fan 30 generates a radial airflow, which blows against the peripheral wall 24*d* of the fan case 24 and is thereby redirected backward. The air then flows to the back side through the outlet port 24*b* provided in the back base plate 24*c* of the fan case 24. In this way, the airflow through the inlet port 24*a* (i.e. suction) is generated for sucking dust. The suction acts on the inside of the dust collecting case 10 through the dust filter 12, and thus the dust is sucked into the collecting case 10 through the suction nozzle 11. In addition, the air generated by rotation of the centrifugal dust suction fan 30 flows to the back side through the outlet port 24*b* provided in the back of the fan case 24. The air does not directly blow against the main body housing 21. Therefore, the vibration of the main body housing 21, which is caused by the unstable outflow, is also reduced.

The upper side of the main body housing 21 is provided with an integrated loop-shaped handle 25 for users to grip.

The front of the handle 25 has, on the inner side, a trigger-like switch lever 28, which may be pulled by a user's finger to be operated. While holding the handle 25 by hand, the user may pull and operate (turn on) the switch lever 28 by his finger. When a main switch 29 is turned on, the electric motor 22 is started. Furthermore, when a user turns on the switch lever 28, an LED light installed on the front of the handle 25 is turned on and illuminates the tip of the dust suction nozzle 11.

A battery pack 26 serving as a power source, is mounted on the back of the main body 20 and below the handle 25. The battery pack 26 may comprise, for example, a 14.4V lithium-ion battery, which is widely used as a main power source for hand electric tools, such as a screw fastening tool or cutting tool. The battery pack 26 can be repeatedly used. The battery pack 26 can be removed from a slide-type battery mount 27 and charged in a separately provided battery charger.

Figure 2:
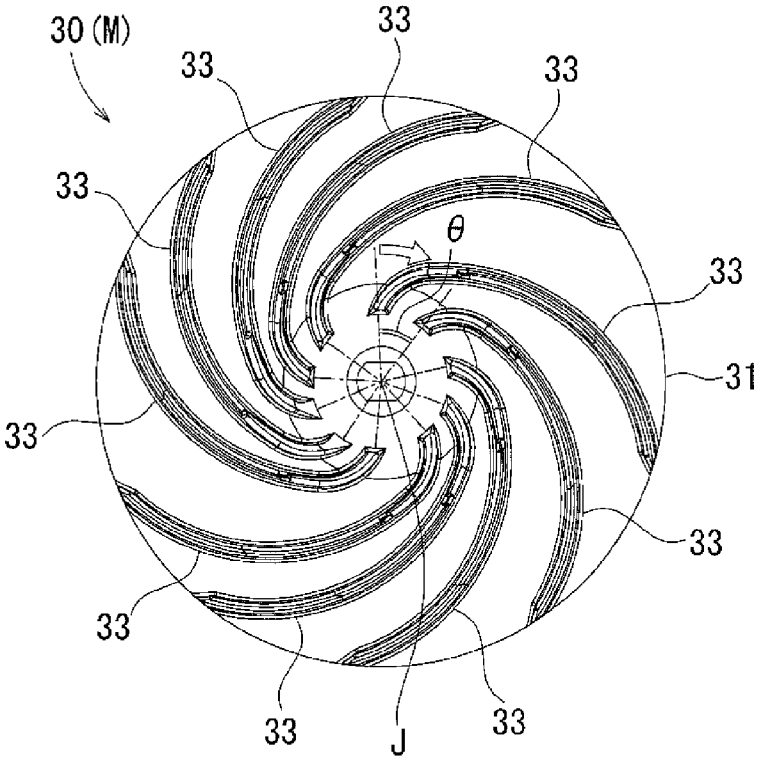
FIG. 2 is a front view of a dust suction fan with a shielding plate (a shroud) removed.

The dust suction fan 30 is provided with means for mainly the reduction of noise. The dust suction fan 30 may comprise what is known as an uneven pitch fan. Since the uneven pitch fan has irregular frequency with regard to its blade passing, the generation of the uncomfortable shrilling blade-passing noise characteristic of fans can be suppressed. The dust suction fan 30 includes a circular base plate or disk 31 which is fixed to an output shaft of the electric motor 22, an annular shielding plate 32 which is disposed substantially parallel to the base plate 31 at a predetermined interval, and a plurality of blades 33 which are disposed between the shielding plate 32 and the base plate 31 at uneven pitches. The inlet port 24*a* of the fan case 24 is positioned with respect to the inlet hole 32*a* provided in the center of the shielding plate 32. FIG. 2 shows the dust suction fan 30 with the shielding plate 32 removed.

Figure 3:
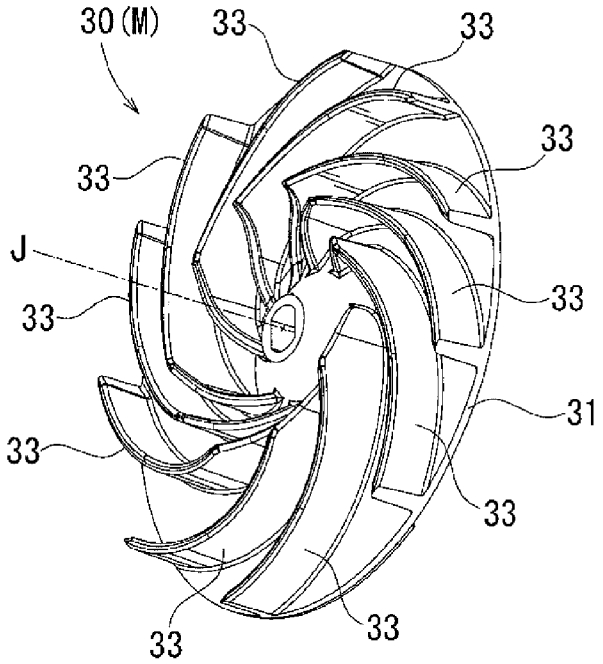
FIG. 3 is a perspective view of the dust suction fan with the shielding plate removed.

As shown in FIG. 3, the blades 33 are integrated with the base plate 31. Each blade 33 has an inner end located near the center of the base plate 31 (where the rotation axis J passes), and extends radially from the inner end, while bending, to the outer end. The inner ends of the blades 33 are positioned substantially on the same circle with the center on the rotation axis J. The circumferential intervals (i.e. angles θ, or pitches) between inner ends of the adjacent blades 33 are not equal, and, as best shown in FIG. 2, are arranged in uneven angles in the circumference. Meanwhile, the curvatures of the bent blades 33 are matched with each other. Therefore, the intervals between the outer ends (on the outer circumference) of the circumferentially adjacent blades 33 are not equal and thus are uneven.

Figure 4:
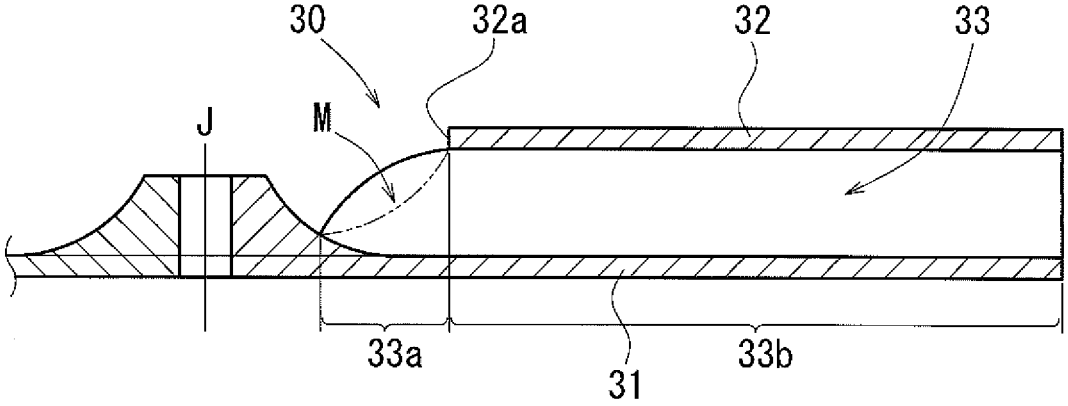
FIG. 4 is an axial cross-sectional view of the dust suction fan with a flattened blade.

As shown in FIG. 4, each blade 33 has a portion on the inner end side which projects into the inlet hole 32*a* in the shielding plate 32, where the height of the portion from the base plate 31 may be slanted, such that it gradually decreases towards the inner end. This height-varying inclined portion of the blade 33 will be hereinafter referred to as the inducer 33*a* of the blade 33. The height of each blade 33 from the base plate 31 is substantially constant between the base plate 31 and the shielding plate 32. This constant-height portion of the blade 33 will be hereinafter referred to as the body 33*b* of the blade 33. Airflow generated by the rotation of the dust suction fan 30 passes through the inlet port 24*a* and through the inlet hole 32*a* in the shielding plate 32, and then is directed radially outward. The inlet of each blade 33 is widely opened by the configuration of the inducer 33*a*, and thereby air can be smoothly taken through the inlet hole 32*a* into the passages between the blades 33.

As shown in a solid line and a two-dot chain line in FIG. 4 (also see FIG. 3), the inducers 33*a* of the blades 33 may have different configurations. The configurations of the inducers 33*a* may be changed as desired so that their face areas differ from each other. It is possible to control the inflow of air into the body 33*b* of each blade 33 by changing the dimensions or face area of the inducer 33*a*. The greater the dimensions or face area of the inducer 33*a*, the larger the volume of air introduced there. On the other hand, the larger the interval θ between the adjacent blades 33, the larger the volume of air that flows out of there. This will result in a possibility that vibration may be generated due to the unstable volume (or unstable volume) of outflow.

Considering this, for the blades 33 with a large interval θ, their inducer 33*a* can be configured to have a small face area to reduce the volume of air introduced there. The radial outflow from between the blade bodies 33*b* is reduced, and thus it is possible to reduce or eliminate the unstableness of outflow in the entirety of the dust suction fan 30. As described above, in this first embodiment, to deal with the vibration caused by unstable outflow, the configuration or the face area of the inducer 33*a* may be properly changed so as to offset the unstable outflow caused by the uneven intervals θ (the uneven pitches) and reduce the vibration.

As described above, in the present embodiments, the handy cleaner 1 (or other power tools) may include a dust suction fan 30 installed in it; the fan having a plurality of blades 33 with uneven pitches between the blades 33. In this way, an uneven pitch fan which has a reduction effect of an uncomfortable noise, such as NZ noise, is installed in the power tool, such as the handy cleaner 1 or a dust collector, as a dust suction fan. Thus, it is possible to achieve noise reduction in the power tool.

The dust suction fan 30 may comprise a centrifugal fan which blows out air in all radial directions. The centrifugal uneven pitch fan allows for preventing the uncomfortable shrilling blade-passing noise (as called NZ noise) generated in the centrifugal fan.

The dust suction fan 30 may be provided with means for correcting the unstable outflow which can be caused by the uneven pitches between the blades 33. The unstable outflow caused by the dust suction fan 30 being an uneven pitch fan is corrected by the means for correcting unstable outflow. As a result, vibration caused by the unstable outflow is reduced. In summary, it is possible to reduce the NZ noise or other uncomfortable noise that is caused due to the dust suction fan 30 being an uneven pitch fan. At the same time, vibration caused by the unstable outflow is reduced by the means for correcting unstable outflow applied in the dust suction fan 30. This allows improved user-friendliness of the handy cleaner 1.

The blades 33 may have inducers of uneven face areas for correcting unstable outflow. In addition to the face area, the inducers of blades 33 may be designed to have uneven configuration in terms of shape, dimension or any other, which changes the outflow of air from between the blades 33. In this manner, it is possible to correct the unstable outflow caused by the uneven pitches and reduce the vibration of the power tool.

Instead of properly changing the configuration of the inducer 33*a*, other means can be taken for correcting unstable outflow, for example, as described below.

Figure 5:
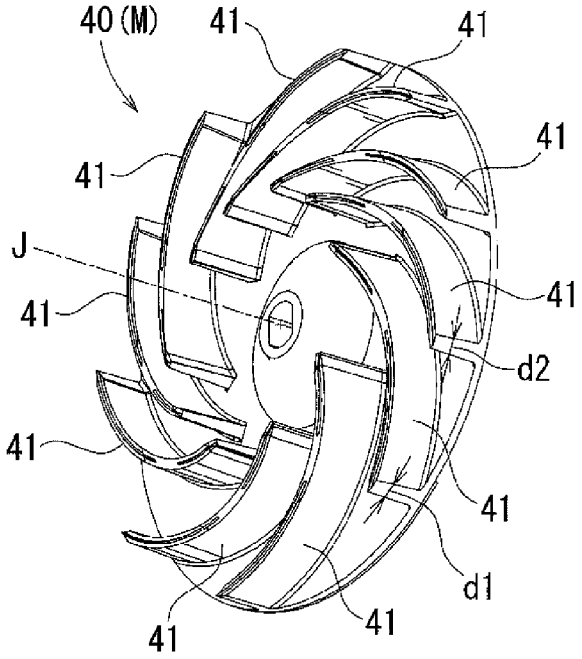
FIG. 5 is a perspective view of a dust suction fan with blades of uneven thicknesses, according to a second embodiment.

In a second embodiment, as shown in FIG. 5, the blades 41 may have uneven thicknesses for correcting unstable outflow. Specifically, a dust suction fan 40 may include some blades of a thickness d1 and other blades of a thickness d2. Thickness d2 is greater than the thickness d1. The larger the thickness of the blade, the smaller the outflow from there. For this reason, the blade at a larger pitch can be designed to have a greater thickness than the thickness of the blade at a smaller pitch. This is done so that the outflow from the larger pitched blade can be adjusted and generally matched with the outflow from the smaller pitched blade. In this way, making use of the fact that the outflow from between the blades varies when the thicknesses of the blades are uneven, it is possible to reduce the vibration of the dust suction fan 30 by correcting the unstable outflow caused by the uneven pitches.

Figure 6:
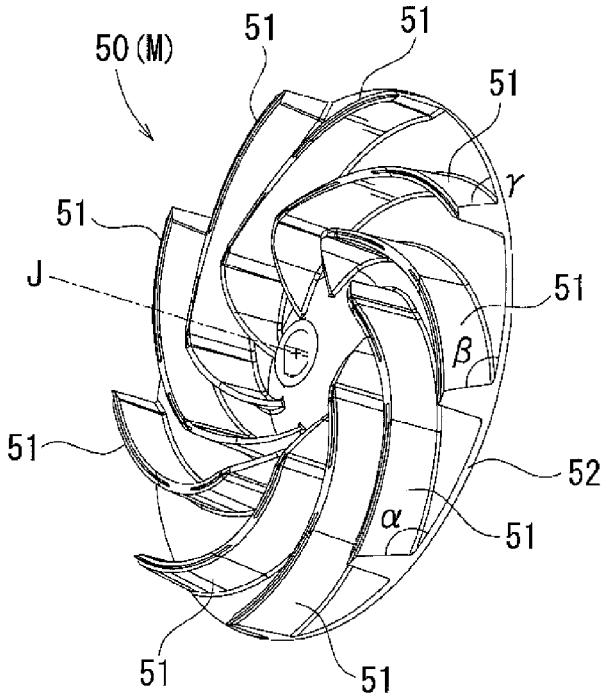
FIG. 6 is a perspective view of a dust suction fan with blades of uneven skew angles, according to a third embodiment.

In a third embodiment, as shown in FIG. 6, the blades may have uneven skew angles (which are the angles of blades 51 with respect to the surface of the base plate 52) for correcting unstable outflow. This dust suction fan 50 also allows for a reduction in vibration by correcting the unstable outflow caused by the uneven pitches of the blades 51. In the fan shown in FIG. 6, all skew angles α, β and γ of the blades 51 are different from each other. Different skew angles α, β and γ of the blades 51 allows for controlling the outflow from between the blades 51. Making use of the fact that the outflow from between the blades varies when the skew angles of the blades are uneven, it is possible to reduce the vibration of the dust suction fan 50 by correcting the unstable outflow caused by the uneven pitches.

As shown in FIG. 1, the handy cleaner 1 (or other power tool) may include a main body housing 21, a fan case 24 with a built-in dust suction fan 30, and a handle 25 provided in the main body housing 21 for users to grip. The handy cleaner 1 may further include a vibration absorber provided between the fan case 24 and the handle 25. The vibration absorber absorbs vibration caused by the unstable outflow from the dust suction fan 30. In the first embodiment above, the handy cleaner 1 includes, as the vibration absorber, the elastic cover 23 which covers the fan case 24. The main body housing 21 supports the fan case 24 via the elastic cover 23. Therefore, the elastic cover 23 (or the vibration absorber) absorbs the vibration which is caused by the unstable outflow, and thus the vibration is prevented from being transmitted to the handle 25. In this manner, the vibration on the handy cleaner 1 user's hand which grips the handle 25 is reduced. This allows improved user-friendliness of the handy cleaner 1.

The dust suction fan 30 may be shielded by the fan case 24 in radial directions so that the radial airflow from the dust suction fan 30 may be prevented from directly blowing against the main body housing 21. In this manner, the airflow is redirected into the axial direction of the dust suction fan 30. Therefore, the vibration of the main body housing 21 is reduced from being caused by the unstable outflow from the uneven pitch fan. In other words, the fan case 24 (or particularly its peripheral wall 24*d*) functions as the vibration absorber. The vibration on the handy cleaner 1 user's hand which grips the handle 25 is reduced because the vibration of the main body housing 21 is reduced by the fan case 24 as the vibration absorber. This allows improved user-friendliness of the handy cleaner 1.

Although embodiments of the present invention are described with reference to the structures above, it should be understood by those skilled in the art that various alterations, improvements, or modifications may be applied insofar as they are within the scope of the present invention. Thus, embodiments of the present invention may include all such alterations, improvements, and modifications without departing from the spirit and the scope of the appended claims. Embodiments of the present invention are not limited to the specific structures described above and can be modified as described below for example.

In addition to what is described above, the deflection angle or inclination of each blade with respect to the radial direction may be changed for correcting or reducing unevenness of outflow caused by the uneven pitch fan (means for correcting unstable outflow M). When the dust suction fan 30 is seen in a plan view as shown in FIG. 2, the deflection angle is, in other words, the circumferential position of the blade on the base plate face (see void arrow in FIG. 2) with respect to a radial line (see dashed lines in FIG. 2) passes through the inner end of the blade. The deflection angles may be changed to control the airflow from between the blades 33. In this way, it is possible to compensate for the unstable outflow caused by the uneven pitches, and reduce the vibration of the fan.

The blades may have uneven deflection angles (or inclination) with respect to radial directions for correcting unstable outflow from the fan. The outflow from between the blades varies when the deflection angles of the blades with respect to radial directions are uneven.

The various means for correcting unstable outflow M described above can be used either alone or in combination. In this way, the unstable outflow caused by the uneven pitches is reduced, and thus can achieve both noise reduction, which is realized by the uneven pitch blades, and vibration reduction of the power tool, which is realized by correcting the unstable outflow.

Even when the blades 41 have no inducers as shown in FIG. 5, unstable outflow can be corrected by other means that do not involve inducers. This allows for the reduction of vibration in power tools.

The means for correcting unstable outflow M can be applied not only to the dust suction fan 30 of a handy cleaner 1, but also to a fan installed in other power tools, such as a motor cooling fan, a blowing fan used in a dust collector, or an engine-powered blower.

For absorbing the vibration caused by the unstable outflow from the dust suction fan 30, the outer surface of the peripheral wall 24*d* may, for example, be covered with a sponge or subjected to raising process, rather than using the elastic cover 23 as a vibration absorber.

Instead of the peripheral wall 24*d* of the fan case 24, a peripheral wall comparable to the peripheral wall 24*d* may be provided, as the vibration absorber, on the main body housing 21 side via an elastic member, and thus radial airflow from the dust suction fan may be prevented from directly blowing against the main body housing 21.

The vibration absorber which is interposed between the handle 25 and the dust suction fan 30 may also be embodied as follows. First, a floating handle structure (an anti-vibration handle) may be applied in which the main body housing supports the handle 25 via an elastic member. Second, the main body housing may be provided with a dual structure. Third, the airflow can be stabilized by arranging a number of dust suction fans in series in the axial direction in such a manner that their phases of uneven pitches are mutually offset. Fourth, the main body housing may support the dust suction fan and fan case via an electric motor. It should be noted that these structures can be applied in combination as desired. Such vibration absorbers also prevent the vibration, which is caused by the unstable outflow from the uneven pitch fan, from being transmitted to the handle 25.

The invention claimed is:

1. A power tool comprising:

a main body housing;

an electric motor;

a fan driven by the electric motor, the fan comprising:

a base plate;

a shielding plate spaced from the base plate, the shielding plate defining a central inlet hole; and a plurality of blades extending between the base plate and the shielding plate, the plurality of blades being at uneven pitches, each blade comprising:

a blade body with an inner and an outer end, each blade body that extends from the inner end to the outer end thereof having the same height from the base plate; and an inducer extending from the inner end of the blade body inwardly into the inlet hole of the shielding plate, each inducer configured to have decreasing height from the base plate in such a manner that each inducer has a different surface area with each other;

a fan case comprising a peripheral wall encasing the fan therein;

a handle for a user to hold provided in the main body housing; and a vibration absorber disposed on the peripheral wall of the fan case, wherein:

the fan case is supported by the main body housing only via the vibration absorber, the electric motor being secured at one end to the fan case, and the vibration absorber absorbs vibration caused by unstable outflow from the fan which may be caused by the uneven pitches between the blades.

2. The power tool according to claim 1, wherein the vibration absorber comprises an elastic cover that covers the peripheral wall of the fan case.

3. The power tool according to claim 1, wherein the fan is shielded in radial directions by the fan case such that the outflow is redirected to the axial direction of the fan for preventing radial airflow from the fan from directly blowing against the main body housing.

4. The power tool according to claim 1, wherein the fan comprises a centrifugal fan which blows out air in radial directions.

5. The power tool according to claim 1, wherein the blades have uneven thicknesses.

6. The power tool according to claim 1, wherein the blades have uneven skew angles, where the skew angle is an angle of the blade with respect to the base plate.

7. The power tool according to claim 1, wherein the blades have uneven deflection angles, where the deflection angle is a central angle between a first radial line through the inner end of the inducer and a second radial line through a portion of the blade at a reference circle concentric with the fan.

8. The power tool according to claim 1, wherein each blade body has the inner end at an edge of the inlet hole in the shielding plate so that the height-decreasing inducer starts at the edge of the inlet hole.

9. The power tool according to claim 1, wherein the inducer for a first blade of the plurality of blades that is at a larger pitch than the inducer for a second blade has the surface area that is smaller than the inducer for the second blade.

* * * * *